US007827742B2

(12) United States Patent
Sansano Marti

(10) Patent No.: US 7,827,742 B2
(45) Date of Patent: Nov. 9, 2010

(54) REMOVABLE COVERING FOR SURFACES

(76) Inventor: Vicente Francisco Sansano Marti, Metge Joan Martí, 8-13, E-12200, Onda (Castellón) (ES)

( * ) Notice: Subject to any disclaimer, the term of this patent is extended or adjusted under 35 U.S.C. 154(b) by 6 days.

(21) Appl. No.: 12/318,791

(22) Filed: Jan. 8, 2009

(65) Prior Publication Data

US 2010/0170176 A1 Jul. 8, 2010

(51) Int. Cl.
*E04F 11/16* (2006.01)

(52) U.S. Cl. ..... 52/177; 52/590.1; 52/392; 52/403.1

(58) Field of Classification Search ..... 52/578, 52/591, 595.5, 592, 519, 384, 390, 392, 574, 52/591.4, 591.2, 403.1, 180, 589.1, 582.2; 428/60, 61, 81, 88, 192
See application file for complete search history.

(56) References Cited

U.S. PATENT DOCUMENTS

| | | | | | |
|---|---|---|---|---|---|
| 3,687,773 | A * | 8/1972 | Wangborg | 156/265 |
| 3,909,996 | A * | 10/1975 | Ettlinger et al. | 52/177 |
| 4,287,693 | A * | 9/1981 | Collette | 52/177 |
| 4,860,510 | A * | 8/1989 | Kotler | 52/177 |
| 4,930,286 | A * | 6/1990 | Kotler | 52/177 |
| 5,640,821 | A * | 6/1997 | Koch | 52/698 |
| 5,787,654 | A * | 8/1998 | Drost | 52/177 |
| 5,950,378 | A * | 9/1999 | Council et al. | 52/177 |
| 5,992,106 | A * | 11/1999 | Carling et al. | 52/177 |
| 6,098,354 | A * | 8/2000 | Skandis | 52/177 |
| 6,751,912 | B2 * | 6/2004 | Stegner et al. | 52/177 |
| 7,340,865 | B2 * | 3/2008 | Vanderhoef | 52/177 |
| 7,516,587 | B2 * | 4/2009 | Barlow | 52/591.2 |
| 7,571,572 | B2 * | 8/2009 | Moller, Jr. | 52/177 |
| 2005/0193669 | A1 * | 9/2005 | Jenkins et al. | 52/392 |
| 2006/0272252 | A1 * | 12/2006 | Moller, Jr. | 52/384 |
| 2007/0044412 | A1 * | 3/2007 | Forster et al. | 52/592.1 |
| 2007/0251172 | A1 * | 11/2007 | Cramer et al. | 52/384 |
| 2008/0216437 | A1 * | 9/2008 | Prevost et al. | 52/589.1 |

* cited by examiner

*Primary Examiner*—Richard E Chilcot, Jr.
*Assistant Examiner*—Alp Akbasli
(74) *Attorney, Agent, or Firm*—Wenderoth, Lind & Ponack, LLP.

(57) ABSTRACT

A removable covering for surfaces includes, in principle, tiles consisting of bases made of a plastic material and top plaques joined to the bases, the bases incorporating male and female anchoring elements along their edges which fit together for attaching one tile to another. The anchoring elements are located in the joints between tiles and the anchoring elements are arranged alternatingly along the entire outer edge of the bases, at least by pairs of anchoring elements, one male and the other female, on each side of the edge of the plastic base. The anchoring elements are separated by a distance which is twice the distance between each end anchoring element and the nearest adjacent vertex of the corresponding base. It will thus be possible to place and anchor one tile assembly in relation to another in as many positions as the number of sides of the tiles.

1 Claim, 8 Drawing Sheets

REMOVABLE COVERING FOR SURFACES

BACKGROUND OF THE INVENTION

The present invention, as stated in the heading of this specification, relates to a removable covering for surfaces applicable to floors, terraces, gardens, swimming pool areas, home interiors, food-handling facilities, etc.

It is easily removable, allowing the proper elimination of water and fluids which may be dropped on its surface.

Comprising mainly paired pieces: a bottom piece as a base or support made of a plastic material and a top piece made essentially of a ceramic material, the two being joined together by their faces in contact with one another, each pair of pieces comprising a tile assembly which is anchored with the adjacent ones by means of ancillary attachment elements located on the perimetric edges of the plastic base piece.

One objective of this invention is a new arrangement of the attachment elements which makes it possible to connect any adjacent edges of the tiles assembly to one another such that the decorative motifs of the ceramic pieces may be combined in different ways.

Another objective of this invention focuses on a new structure of the attachment elements, thus achieving a better connection of the pieces with a greater degree of stability, whilst also making the vertical removal of each tile assembly easier.

Also innovative is the placement of the starting point of the attachment elements, by means of which sturdier, stronger anchorings are achieved.

Means are also included for centering the top piece with respect to the bottom piece, these means also allowing for a physical separation between the different tile assemblies.

Different floor coverings currently exist, special mention being made of those which are applied to exterior surfaces for facilitating the elimination of rainwater and also in swimming pool areas.

In some cases, the coverings comprise pieces made of a plastic material which are of a hollow structure of a certain thickness forming a water-removal chamber underneath.

These coverings can entail hygiene-related problems, which aesthetically also leaves much to be desired.

In other cases, the coverings comprise bodies manufactured using porous materials, which, although it be true that they are capable of eliminating a certain flow of water, do become saturated at higher flowrates. The porosity of such bodies also facilitates, in some cases, the proliferation of fungi and bacteria.

Spanish Patent No. P-200402065 consists of a covering for surfaces comprising the combination of certain bottom draining support elements and top plaques which are attached to said supporting bodies such that when water falls on this covering, be it rainwater, pool water or other types of water, this fluid does not remain on the outer exposed surface, but rather runs into the bottom chamber formed by the draining supporting elements through separating grooves between the plaques when they are made of a ceramic or similar material.

All of these coverings, including that of Spanish Patent No. P-200402065, have the limitation of not being able to attach any one of the perimetric edges of the tile assemblies adjacent to one another to each other, which limits the possibilities of achieving different combinations in the decoration of the ceramic pieces.

To cover all of these possibilities, it would be necessary to place the decoration of the tiles in several different positions or to join the ceramic piece to the base in different positions, which would complicate the entire process.

SUMMARY OF THE INVENTION

For the purpose of accomplishing the objectives and avoiding the drawbacks mentioned in the preceding sections hereinabove, this invention proposes a removable covering for surfaces comprising, in principle, bottom draining support elements consisting of bases made of a plastic material and top plaques which are attached to the aforesaid bottom plastic basis, such that when water falls on this covering, whether it be rainwater, pool water or other types of water, this fluid will not remain on the outer exposed surface, but rather will run into the bottom chamber formed by the draining support elements, through separating grooves or joints between the plaques when these plaques are made or a ceramic or similar material.

This combination of elements provides a covering inhibiting both moisture as well as water build-up thanks to the water running into the bottom chamber formed by the supporting elements which are essentially made of plastic.

The side edges of the plastic supports incorporate attachment elements to assure the anchoring among such adjacent supports and therefore of the tile assembly as a whole.

The covering is characterized in that the arrangement of the attachment elements makes it possible to connect one supporting base to another adjacent base in as many possible positions as the number of sides on these supports.

For example, the supports and respective plaques are most customarily quadrangular in shape, such that, in this case, there will be four possible relative positions. For a triangular shape, there would be three; for a hexagonal shape, there would be six, etc.

To achieve this range of possibilities, each side of the supports will have at least two attachment elements, one male and the other female, uniformly distributed, all sides thereof having the same distribution of attachment elements in order to make it possible for a support to be attachable to another by any of its sides.

These characteristics of the invention afford a wide range of possibilities, such that, for example, when the plaques decorated in the same way are placed in a certain position, it is possible to achieve different combinations in the final outcome of the covering.

Another characteristic of the invention is that the anchoring elements are of a particular polygonal structure, the flat sides of which fit exactly into the separating groove between adjacent tiles.

Another characteristic of the invention is that the anchoring elements are molded below the adhering plane of the top piece and are made to line up with any of the short supporting feet which the bottom draining support element incorporate for the purpose of gaining rigidity which would otherwise give rise to weak anchorings.

Another characteristic of the invention is that the supporting base incorporates some narrow dividers around its perimetric edges, which serve as means of centering and holding the top piece or adhered tile in place on the bottom support.

Also innovative is the fact that the dividers mentioned in the immediately preceding paragraph hereinabove are placed off-center on all of the sides, such that, following installation, the dividers of adjacent pieces are at no time facing one another, which could be damaging to the joint between tiles.

In following, in order to facilitate a better comprehension of this specification and comprising an integral piece thereof, some figures are presented illustrating the object of the invention for illustrative and non-limiting purposes.

DETAILED DESCRIPTION OF THE PREFERRED EMBODIMENT

Figure 1:
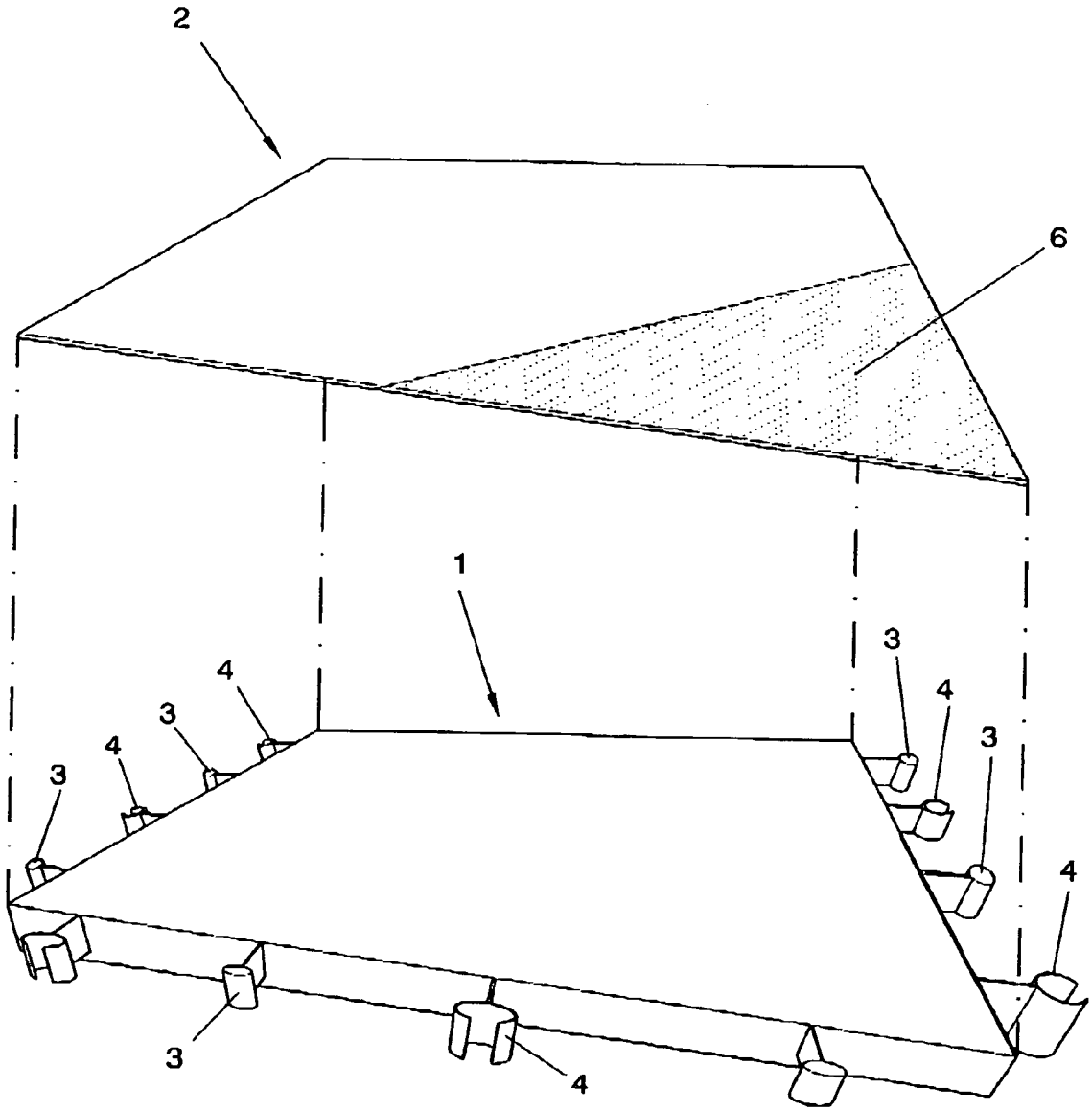
FIG. 1 shows a blown-up perspective view of a tile assembly being a part of the removable covering for surfaces which are the object of the invention. This tile assembly comprises mainly a supporting base made of a plastic material and a top plaque attached to the aforesaid base. The supporting base incorporates male and female elements on the sides thereof for assuring the anchoring among the tile assemblies.
Figure 2:
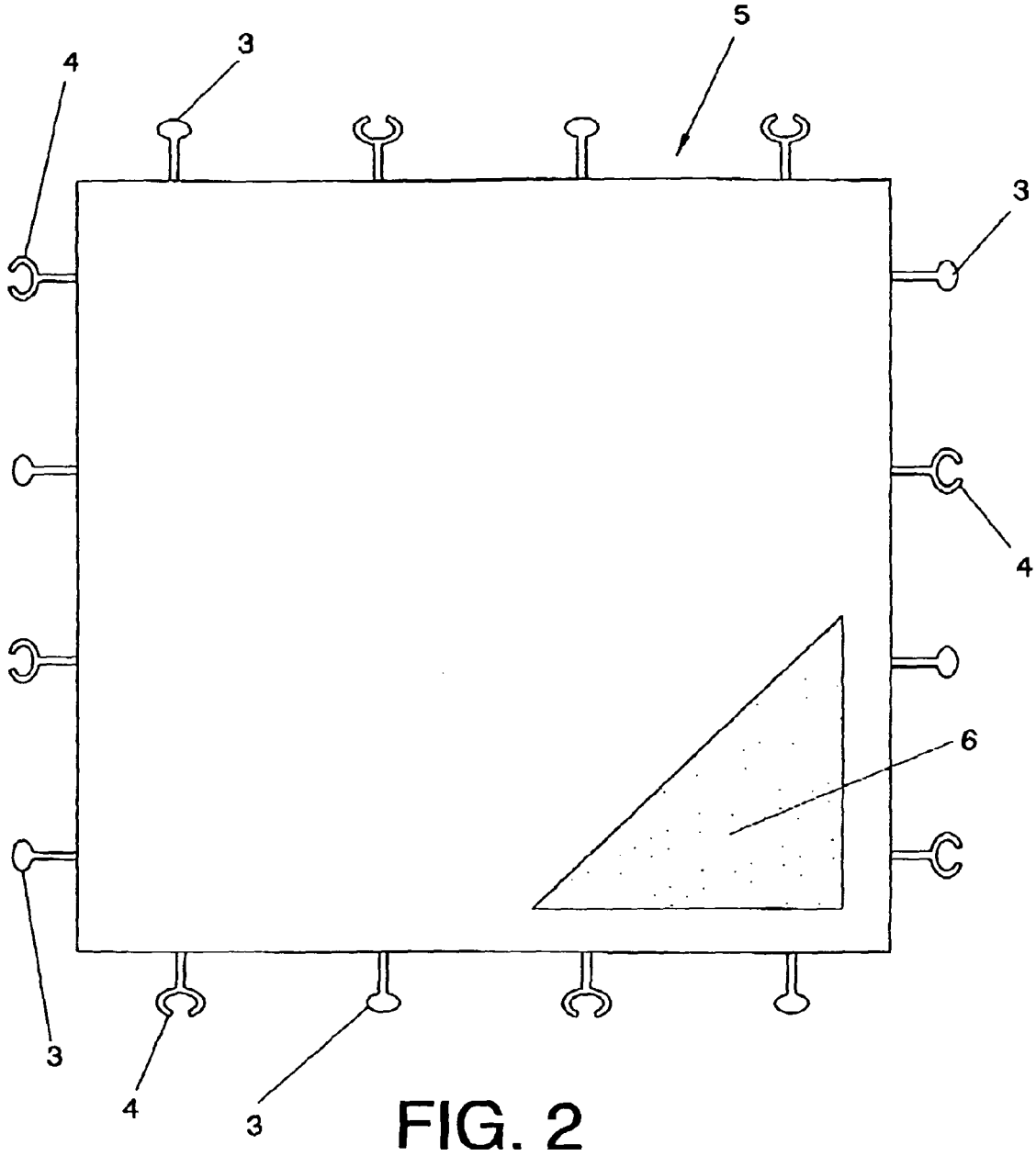
FIG. 2 shows a plan view of that which is shown in the immediately preceding figure hereinabove.
Figure 3:
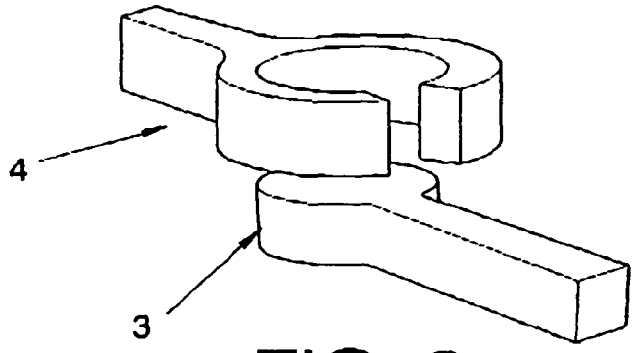
FIG. 3 shows a detailed view of the coupling between a male and female element pertaining to two adjacent base supports being part of two tile assemblies.
Figure 4:
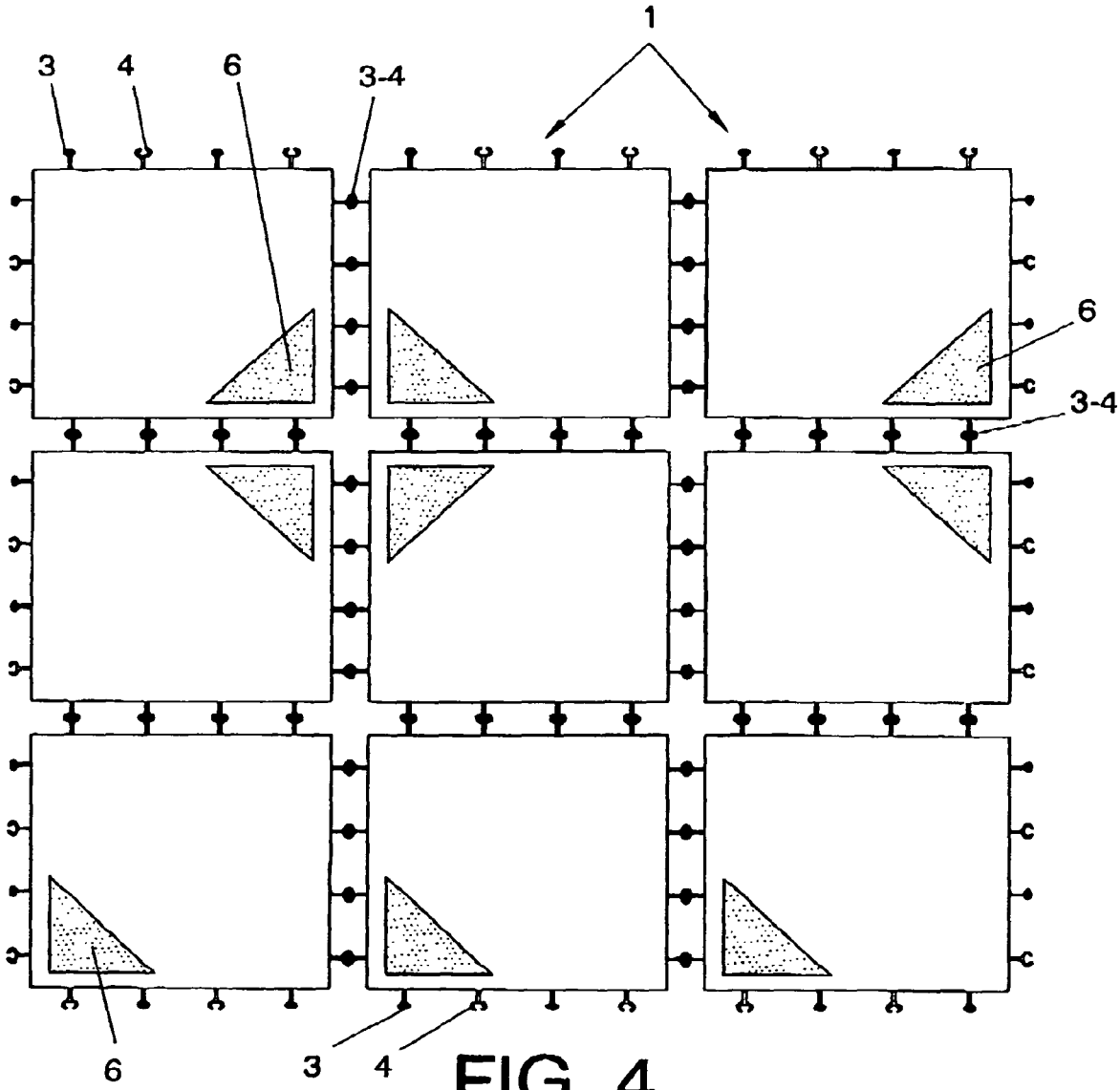
FIGS. 4 and 6 show respective plan views of coverings where the improvements of the invention afford the possibility of distinguishing among several decorative possibilities in keeping with the motifs of the top plaques.
Figure 5:
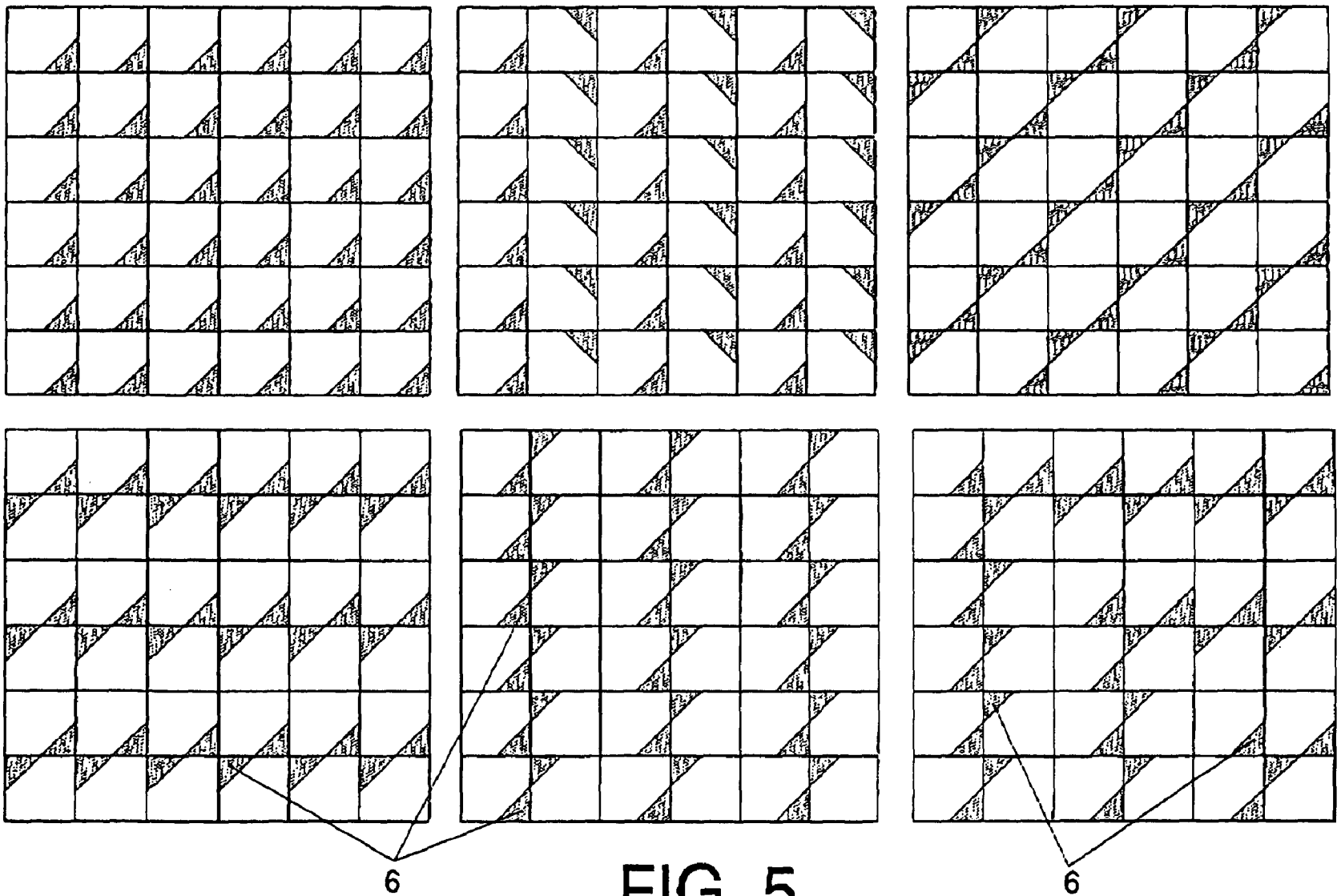
Figure 6:
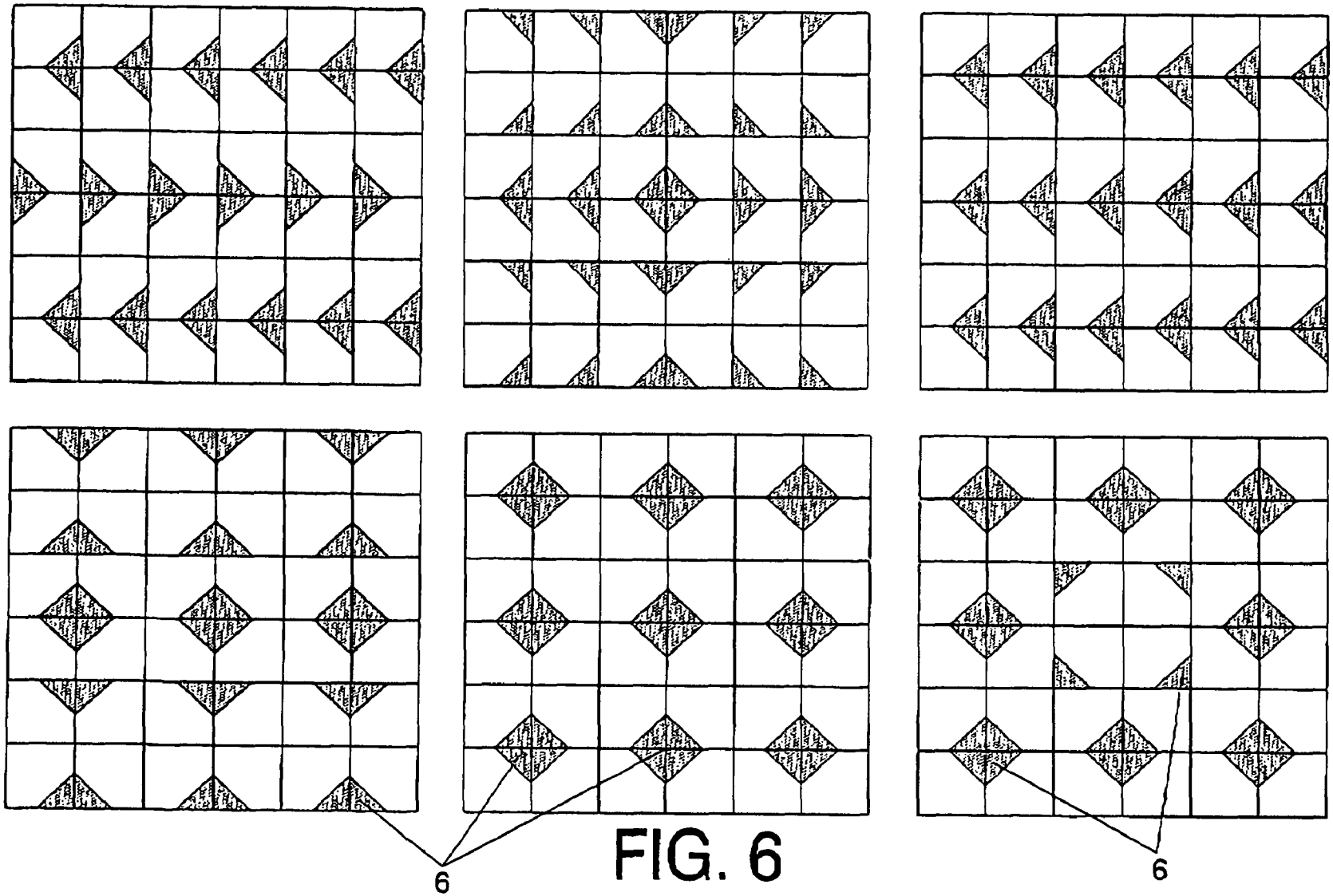

Considering the numbering used in the figures, the removable covering for surfaces of the invention is determined starting from a base or support (1) made of a plastic material, to the top sides of which plaques made of a ceramic material or other materials (2) are attached by means of an adhesive to thus form composite tiles which are joined to one another by means of male anchoring elements (3) and female anchoring elements (4) which are complementary to one another and which project out from the side edges of the aforesaid plastic supports (1) forming an integral part thereof.

The alternating distribution of the male (3) and female (4) elements, as well as the distance between them, makes it possible to place a tile assembly (5) in relation to another in as many positions as the number of sides of the tile, a wide range of possibilities being achieved with regard to the decorative motifs (6) of the free face of the top plaques (2).

Therefore, the direction in which the plastic supports (1) are placed does not matter, given that all of them are identical, their male (3) and female (4) elements being distributed alternating along the entire perimetric edge of the plastic support (1). Thus, a greater ease of handling is achieved for mounting the installation.

Therefore, the sides of the base supports (1) will be of the same length, whilst each one thereof will also incorporate pairs of anchoring elements: one female (4) and the other male (3), the distance between the two being twice the distance between each end anchoring element and the respective closest adjacent vertex of the base support (1).

If each side of the supports (1) incorporates four anchoring elements (male and female arranged alternatively as shown in the figures), the distance between them will be twice the distance between each of the end anchoring elements and the nearest adjacent vertex of the tile assembly. The plastic supports (1) incorporate on their bottom side some short legs for standing on the ground, located in the center (7) and on the perimetric edges (7'), thus creating a chamber for removing the rainwater, pool water, etc.

Figure 7:
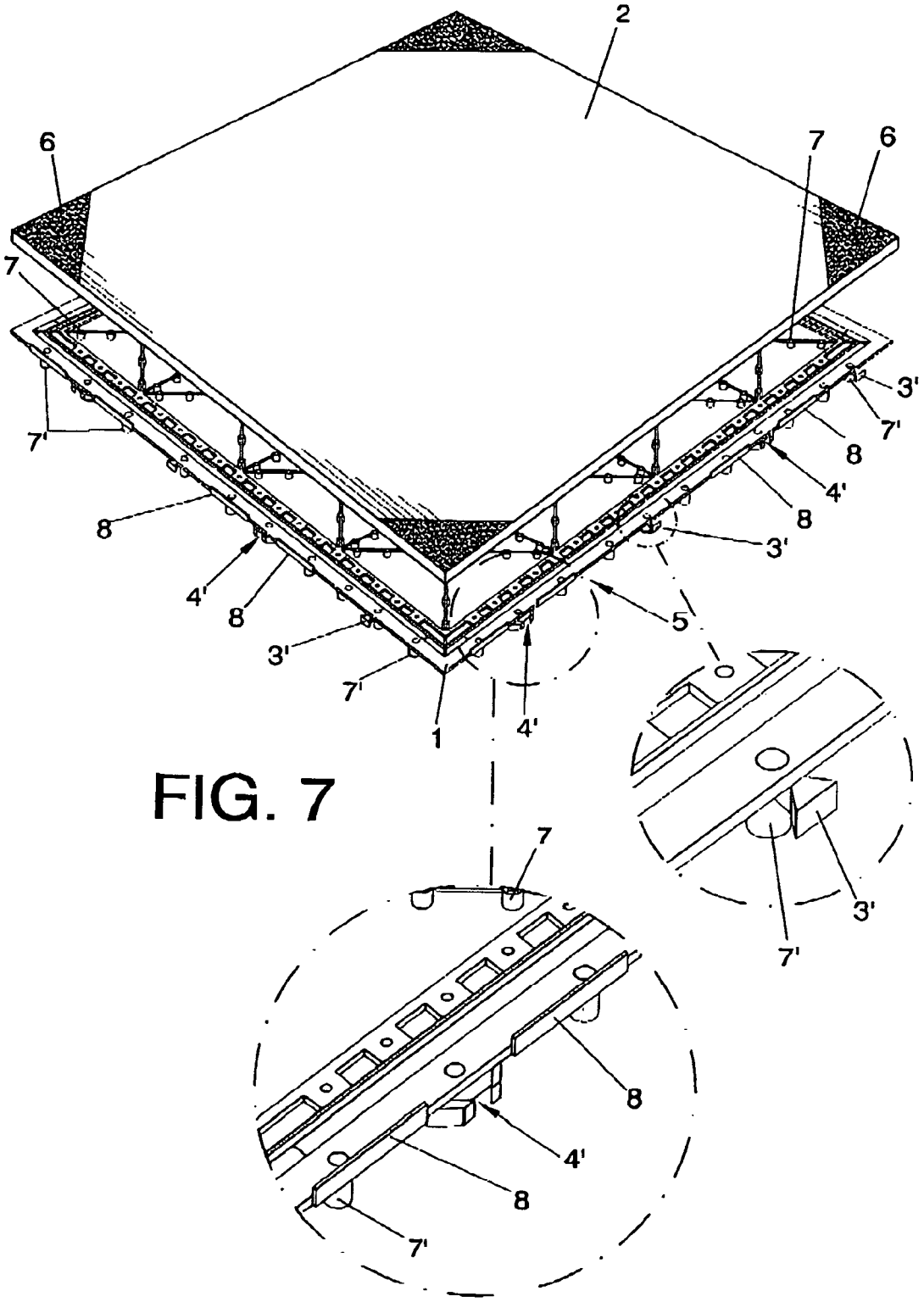
FIG. 7 shows a blown-up perspective view of a tile assembly forming piece of a removable covering for surfaces of the invention. This tile assembly comprises mainly a bottom support made of a plastic material and a top plaque attached to the aforesaid base. The bottom support incorporates male and female elements on its sides for assuring the anchoring among the tile assemblies.
Figure 8:
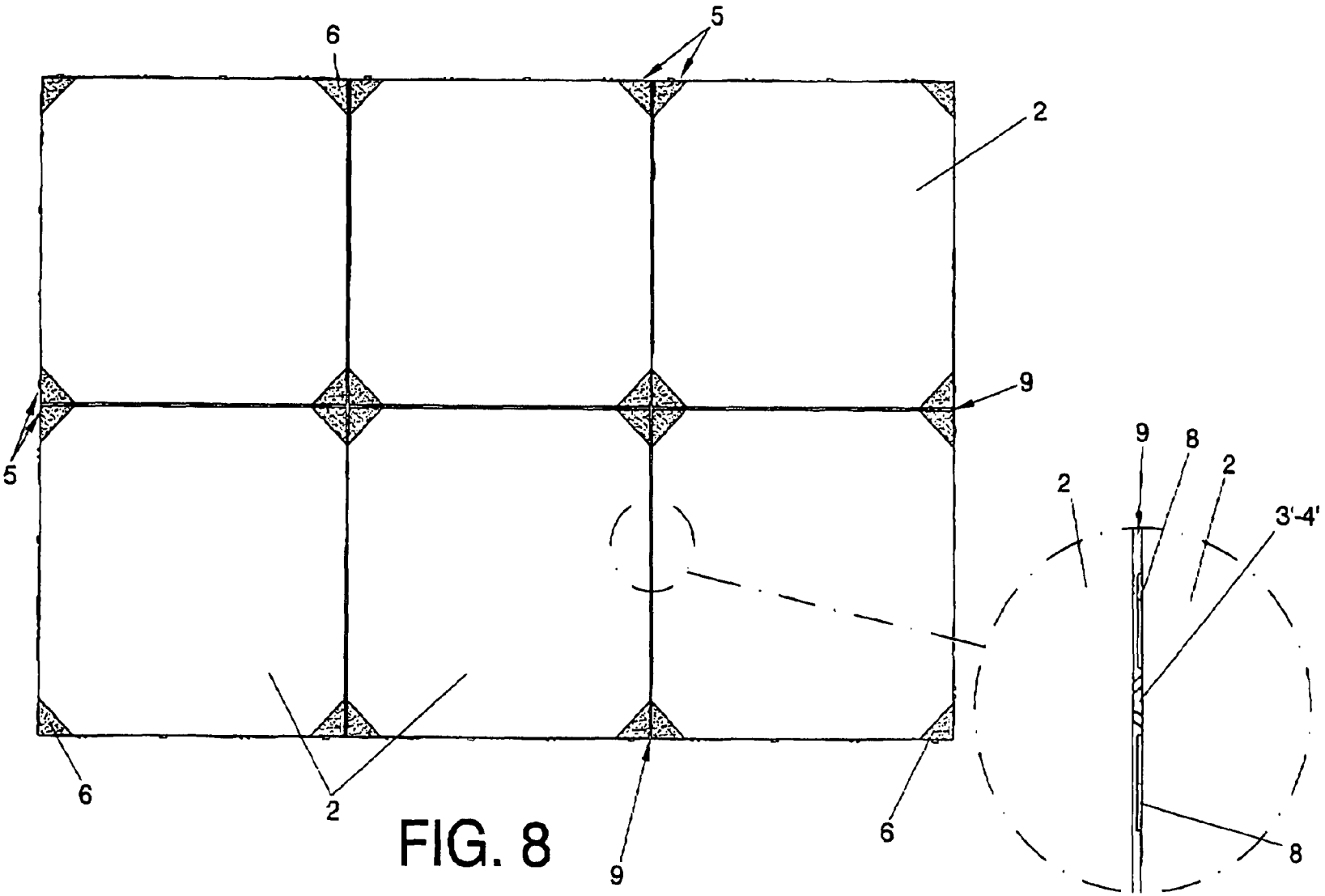
FIG. 8 shows a plan view of a removable covering incorporating several tile assemblies.
Figure 9:
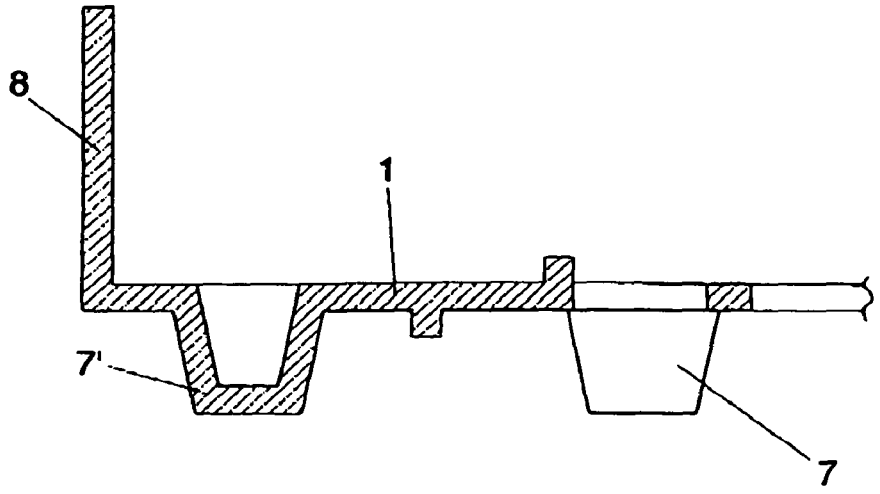
FIG. 9 shows a cross-sectional view of one piece of the perimetric edge of the supporting base depicting one placement of dividers on the perimetric edge for centering the top plaque in relation to the supporting base made of a plastic material.
Figure 10:
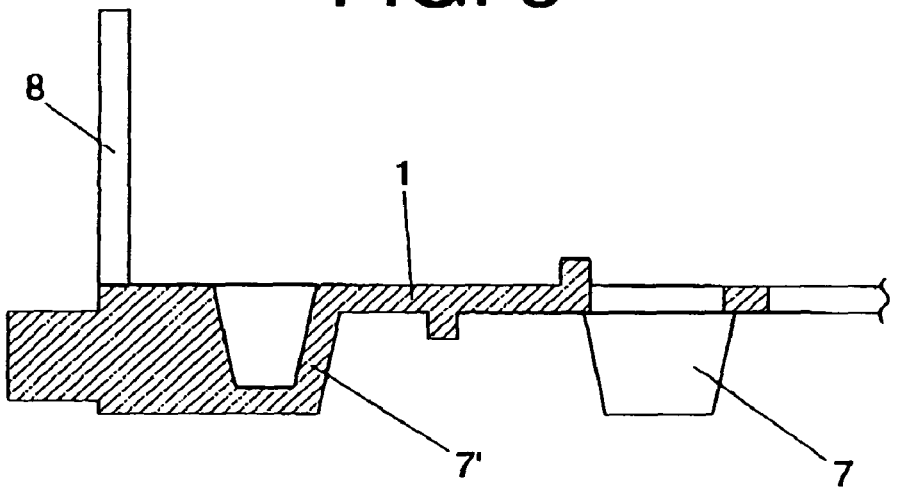
FIGS. 10 and 11 respectively show views of the male and female elements of the supporting base made of a plastic material.
Figure 11:
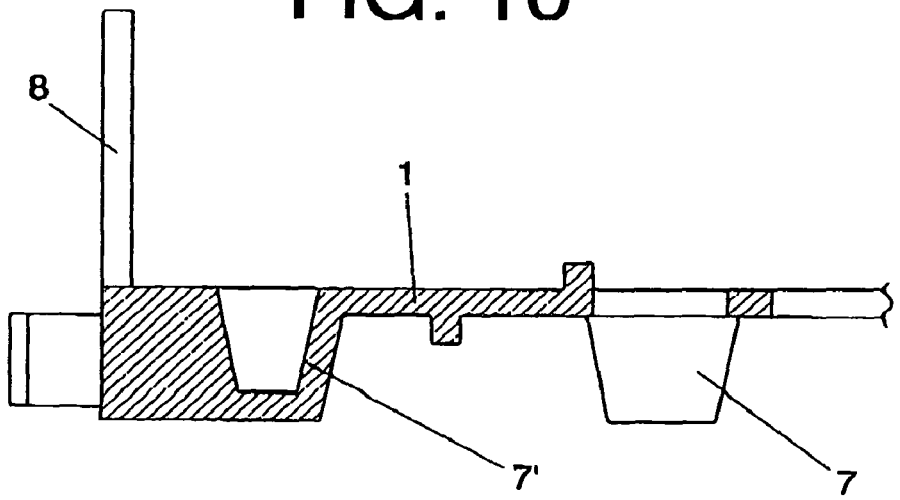

As is shown in FIGS. 7-11, the male anchoring elements (3') and female anchoring elements (4') can adopt a polygon structure, essentially triangular in shape, in the form of a dovetail, the three planes of which project or extend outside of the perimeter of the plastic support, at least in the case of the male anchoring element (3'). This configuration improves the connection of the pieces and makes it more stable, also allowing for the vertical removal of the tile.

The male anchoring elements (3') and female anchoring elements (4') are molded below the adhering plane of the ceramic piece (2), whilst the anchoring elements (3') and (4') are made to line up with some of the short legs along the perimetric edge (7') for standing on the ground for the purpose of gaining in rigidity and sturdiness by being strongly attached thereto (7').

Furthermore, along the outer free edge of the sides of the plastic base support (1) there are some small lengthwise dividers (8) which serve as a means of holding in place and centering the positioning of the ceramic plaques (2) which rest on the top side of the plastic support (1), being adhered thereto.

The aforesaid lengthwise dividers (8) are distributed such that, following installation, the dividers of the adjacent tiles (5) will be facing one another, which could be damaging for the separating joint (9) between tiles (5), said dividers (8) being contained in line with the separating joint (9) between tiles (5).

The triangular shape of the male anchoring elements (3') and female anchoring elements (4') provides an important advantage, which is that it makes it possible to further reduce the width or separation between tiles, creating thinner joints, unlike other previously-known attachments which create wider joints.

The invention claimed is:

1. A removable covering for surfaces, comprising tiles each formed of a base made of a plastic material with short supporting legs for standing on the ground and a top plaque, some of the top plaques being joined together by their faces in contact, edges of the plastic base also incorporating male and female anchoring elements for joining the tiles to one another, wherein:

the male and female anchoring elements are arranged alternatingly along the entire edge of the plastic base; at least by pairs of anchoring elements, one male and the other female, on each side of the plastic base, being the distance between them twice the distance between each end anchoring element and the nearest adjacent vertex of the plastic base, all in order to position and anchor a tile in relation to another in as many positions as the number of sides of the tiles;

the anchoring elements adopt a polygonal structure, the planes of which are contained in separation joints between tiles, said anchoring elements being located below the adhering plane of the top plaques, whilst said anchoring elements originate from some of the short legs on the perimetric edge for standing on the ground;

the anchoring elements are of the configuration in the form of a dovetail;

the removable covering for surfaces incorporate some narrow dividers around outer edges originating from a free outer edge of the plastic base, said dividers being arranged in line with a separating joint between the tiles and the ceramic plaques contacting each other through their outer edges and over the dividers; and the dividers along two facing sides of two adjacent tiles pertaining to two adjacent tiles are positioned on one same plane contained in the separating joint.

* * * * *